US009725846B2

(12) United States Patent
Frias Gomez

(10) Patent No.: US 9,725,846 B2
(45) Date of Patent: Aug. 8, 2017

(54) ACCESSORY FOR THE MATCHING OF GARMENTS

(71) Applicant: Jose Carlos Frias Gomez, Guamasa la Laguna (ES)

(72) Inventor: Jose Carlos Frias Gomez, Guamasa la Laguna (ES)

( * ) Notice: Subject to any disclaimer, the term of this patent is extended or adjusted under 35 U.S.C. 154(b) by 51 days.

(21) Appl. No.: 14/922,749

(22) Filed: Oct. 26, 2015

(65) Prior Publication Data

US 2016/0138210 A1 May 19, 2016

(30) Foreign Application Priority Data

Nov. 19, 2014 (ES) ..... 201400929 U

(51) Int. Cl.
*D06F 95/00* (2006.01)

(52) U.S. Cl.
CPC ..... *D06F 95/008* (2013.01); *Y10S 24/29* (2013.01); *Y10T 24/23* (2015.01); *Y10T 24/318* (2015.01)

(58) Field of Classification Search
CPC ..... D06F 95/008; Y10T 24/318; Y10T 24/23; Y10S 24/29
See application file for complete search history.

(56) References Cited

U.S. PATENT DOCUMENTS 3,774,267 A * 11/1973 Sneider ..... D06F 95/008 24/129 B
2008/0222778 A1* 9/2008 Dierssen-Morice .. D06F 95/008 2/239

* cited by examiner

*Primary Examiner* — Robert J Sandy
(74) *Attorney, Agent, or Firm* — Cook Alex Ltd.

(57) ABSTRACT

An accessory for the matching of garments is provided that includes a strip of a flexible material having first and second ends with a fastening element at each end. The fastening elements are preferably in the form of clamps. The fastening elements and the strip may be colored and made of a material that does not damage the garments. The strip may also include cooperating elements intermediate its ends for securing the strip in a folded condition.

3 Claims, 2 Drawing Sheets

ACCESSORY FOR THE MATCHING OF GARMENTS

TECHNICAL FIELD

The accessory that is the object of this invention may be included within the field of accessories intended for the handling and sorting of garments, such as hangers, pegs, etc. Specifically, the present invention is intended to be used within the field of the domestic arrangement of garments intended to be used in pairs.

STATE OF THE PRIOR ART

Currently there are many accessories of the aforementioned type in the market, such as hangers, pegs, etc.

Several tools or accessories are known in the art that follow an approach similar to the one shown herein and provide solutions whose implementation involves certain limitations or technical conditions.

The accessory of the invention tries to circumvent such limitations or conditions, by providing a much more versatile accessory.

OBJECT OF THE INVENTION

Garments intended to be used in pairs present the problem that they can be mistakenly used, as a consequence of a confusion raised as a consequence of the normal wear of the garments due to the high number of washes of same.

Another inconvenience posed by those garments intended to be used in pairs appears if any of them is lost. On many occasions, this problem involves the discarding of the remaining garment.

As it has been already mentioned in the state of the art, there are certain tools or accessories that solve the aforementioned problems, but these articles deteriorate the garment, as they must be incorporated into them.

Furthermore, the aforementioned invention allows the possibility of using it as a general-purpose organisation accessory, thus providing the option of matching randomly-selected garments with a single accessory.

Another advantage provided by the invention is the versatility offered when drying the garments.

DESCRIPTION OF THE INVENTION

Figure 1:
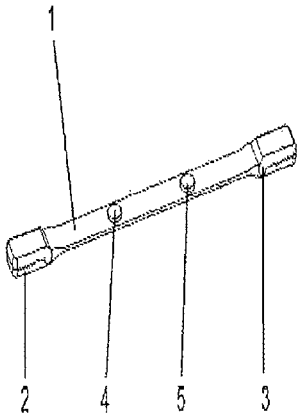
FIG. 1.—Shows a perspective view of the accessory.
Figure 2A:
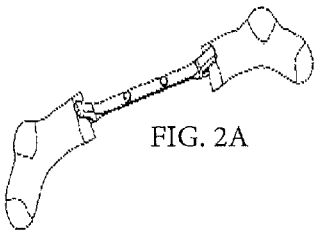
FIG. 2A—Shows an exemplary manner in which the accessory can be used.
Figure 2B:
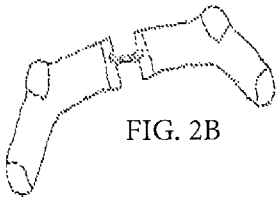
FIG. 2B—Shows a second exemplary manner in which the accessory can be used.
Figure 3:
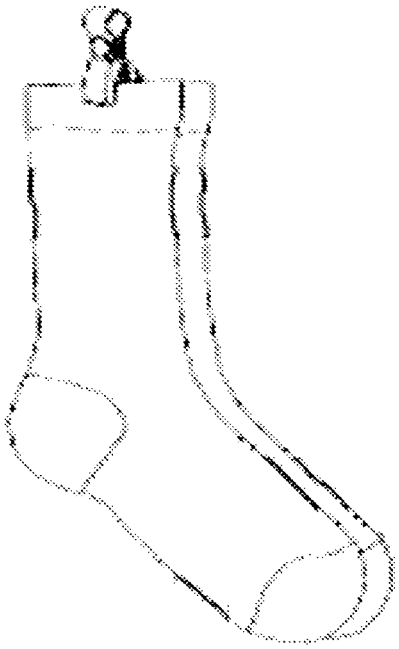
FIG. 3.—Shows a third example of the manner in which the accessory may be used.

The accessory intended for the matching of garments, comprising a strip and two clamps, is characterised in that such strip is fully flexible and, consequently, it allows that the accessory can be used with cleaning devices, such as washing machines or dryers, etc. Furthermore, the strip also comprises a closing mechanism which, once operated, creates a space wherein a washing line can be inserted. Optionally, each end includes a clamp intended to hold the garments. Such clamps are made of a material that is resistant and is not subject to deterioration. As in the case of the above-mentioned strip, the clamps must not cause damages due to the contact with the garment and the cleaning devices.

To facilitate users the identification of the owner of the garments, the accessory may incorporate identification items or elements. For example, the strip and fastening elements of the accessory may be coloured to facilitate recognition.

Description of a Preferred Embodiment

Referring to the attached figures, and following the numbering order shown in such figures, the accessory for the matching of garments comprises a strip (1) made of a material, preferably silicone. Preferably, each end of said strip (1) contains fastening elements (2 and 3) that preferably act as clamps. Such fastening elements (2 and 3) are preferably made of a rigid plastic material, including any material which has the required characteristics in terms of resistance, non-deterioration and which does not cause rusting.

Preferably and approximately at the central part, the strip (1) contains a closing system comprising a protruding "male" element (4) and a receiving "female" element (5). The material used for the closing system will be preferably plastic, although other materials that do not cause deterioration and rusting should not be discarded.

The invention claimed is:

1. An accessory for the matching of garments, comprising a strip (1) of a flexible material having first and second ends and two fastening elements (2 and 3), arranged at the ends of the strip (1) wherein said flexible material comprises silicone, the two fastening elements comprise clamps, and the strip further comprises a protruding element (4) and a receiving element (5) positioned intermediate the first and second ends that cooperate to secure the strip in a folded condition.

2. The accessory for the matching of garments according to claim 1 wherein the strip and fastening elements that comprise such accessory are coloured.

3. A method for laundering matched garments, the matched garments comprising at least first and second clothing articles, utilizing a flexible strip comprising first and second ends with a fastening element at each end and a protruding element (4) and a receiving element (5) positioned intermediate the first and second ends that cooperate to secure the strip in a folded condition; the method comprising:

- securing the first clothing article to the flexible strip with the fastening element at the first end of the flexible strip;
- securing the second clothing article to the flexible strip with the fastening element at the second end of the flexible strip;
- washing the first and second clothing articles with the flexible strip secured thereto; and
- drying the first and second clothing articles with the flexible strip secured thereto by securing the first and second clothing articles with the flexible strip secured thereto to a clothesline by folding the strip back on itself around the clothesline and securing the protruding element to the receiving element.

* * * * *